US011039260B2

(12) United States Patent
Mirsky et al.

(10) Patent No.: US 11,039,260 B2
(45) Date of Patent: Jun. 15, 2021

(54) COMMUNICATION SYSTEM FOR CONTROLLING THE SEQUENCE AND DURATION OF SPEECHES AT PUBLIC DEBATES

(71) Applicants: Jerry Mirsky, Owings Mills, MD (US); Boris Kokotov, Baltimore, MD (US); Daniel Mirsky, Owings Mills, MD (US)

(72) Inventors: Jerry Mirsky, Owings Mills, MD (US); Boris Kokotov, Baltimore, MD (US); Daniel Mirsky, Owings Mills, MD (US)

( * ) Notice: Subject to any disclaimer, the term of this patent is extended or adjusted under 35 U.S.C. 154(b) by 0 days.

(21) Appl. No.: 16/576,673

(22) Filed: Sep. 19, 2019

(65) Prior Publication Data

US 2021/0092542 A1 Mar. 25, 2021

(51) Int. Cl.

| | |
|---|---|
| ***H04R 29/00*** | (2006.01) |
| ***H04R 1/40*** | (2006.01) |
| ***H04R 3/00*** | (2006.01) |

(52) U.S. Cl.

CPC ..... *H04R 29/005* (2013.01); *H04R 1/406* (2013.01); *H04R 3/005* (2013.01)

(58) Field of Classification Search

CPC ..... H04M 3/53; H04M 1/6041; H04M 11/04; H04M 1/72536; H04M 2242/04;

(Continued)

(56) References Cited

U.S. PATENT DOCUMENTS

| | | | |
|---|---|---|---|
| 4,079,583 | A | 3/1978 | Larson |
| 4,090,032 | A | 5/1978 | Schrader |

(Continued)

FOREIGN PATENT DOCUMENTS

| | | | |
|---|---|---|---|
| CN | 2711784 | Y | 7/2005 |
| CN | 203039847 | U | 7/2013 |

(Continued)

OTHER PUBLICATIONS

Dsan Corporation, The Deliberator, URL/website, https://www.dsan.com/SpeakTimers/DelibIntro.asp, Roslyn Heights, NY, US.

*Primary Examiner* — Lun-See Lao

(74) *Attorney, Agent, or Firm* — US IP Attorneys, P.C.; Timothy Marc Shropshire

(57) ABSTRACT

The present invention is a communication system for use in debates, for example, in Congress, Parliament, Presidential elections, online meetings, webinars, etc. The system includes multiple single-channel, time-controlled microphones, each having a STOP button. The STOP button activates the next speaker's microphone and timer while turning off the timer and microphone of the current speaker. The microphones can only be activated by the host or by the STOP button of another microphone. This prevents speakers from interrupting one another. If the time limit is reached, STOP button-activated-control is relinquished to the next speaker and his/her timer and microphone is activated. The remaining and/or elapsed time of each speaker may be displayed on computer screens of each participant, on a display for the audience and/or on lighted digital displays and/or dials. Time limits and the sequence of speeches may be altered by the host.

5 Claims, 3 Drawing Sheets

(58) Field of Classification Search
CPC ..... H04M 2250/22; H04M 3/42153; H04M 3/5116; H04M 11/10; H04M 1/2478; H04M 1/2535; H04M 1/6083; H04M 1/72502; H04M 1/72547; H04M 1/72561; H04M 3/22; H04M 3/42314; H04B 1/385; H04B 1/082; H04B 1/54; H04H 60/80; H04H 60/85; H04R 1/1041; H04R 2227/003; H04R 2227/009; H04R 2420/01; H04R 2420/07; H04R 2430/01; H04R 27/00; H04R 3/12; H04R 1/028; H04R 3/04; H04Q 2213/13093; H04Q 2213/13332
USPC ..... 381/921, 56–58, 300, 81, 77, 76, 79; 700/94; 348/14.1, 14.01–14.09
See application file for complete search history.

(56) References Cited

U.S. PATENT DOCUMENTS

| | | | | |
|---|---|---|---|---|
| 5,673,327 | A | 9/1997 | Julstrom | |
| 8,457,614 | B2 * | 6/2013 | Bernard | H04M 3/56 455/416 |
| 9,232,185 | B2 | 1/2016 | Graham et al. | |
| 9,641,947 | B2 * | 5/2017 | Loether | H04R 27/00 |
| 2003/0059061 | A1 * | 3/2003 | Tsuji | H04N 7/15 381/92 |
| 2007/0030984 | A1 | 2/2007 | Gotfried | |
| 2007/0064925 | A1 * | 3/2007 | Suzuki | H04R 3/005 379/420.01 |
| 2016/0036962 | A1 * | 2/2016 | Rand | H04W 76/25 455/418 |
| 2020/0099388 | A1 * | 3/2020 | Lesso | H03K 17/6871 |

FOREIGN PATENT DOCUMENTS

| | | | |
|---|---|---|---|
| CN | 207560200 | U | 6/2018 |
| EP | 1686835 | A1 | 8/2006 |
| GB | 2174268 | B | 12/1989 |
| JP | H07162989 | A | 6/1995 |

* cited by examiner

COMMUNICATION SYSTEM FOR CONTROLLING THE SEQUENCE AND DURATION OF SPEECHES AT PUBLIC DEBATES

CROSS-REFERENCE TO RELATED APPLICATION(S)

Not applicable.

BACKGROUND OF THE INVENTION

1. Field of Invention

This invention relates to microphones.

2. Description of Related Art

In ancient times an hourglass stood on a podium in front of the speaker. Before the speaker began to speak, he turned the hourglass over and before all the sand had fallen, he had to finish his speech.

Currently, time limits for debates, for example, in Congress, Parliament, Presidential elections, online meetings, webinars, etc., are loosely enforced due, in part, to poor moderation. Speakers speak over moderators and ignore the moderators' request to stop speaking. Given enough persistence by the speakers, the moderators eventually give in and allow the speakers to finish speaking, giving undue speaking time to speakers speaking beyond their time limit or out of order. This is especially evident with televised debates. As a result, while time limits may be given, those time limits are more akin to time goals.

Debates are typically scheduled for a pre-determined window of time, especially when televised. By not adhering to time limits and by allowing speakers to speak out of order, the debates oftentimes go beyond their allotted time frame, creating inconveniences for the audience, etc. Additionally, current systems allow for speakers to be interrupted. This may lessen the effectiveness of the speakers' message, due to distraction of the audience. Further, it may allow more speaking time for some speakers, creating an unfair advantage for other speakers.

Foreign patent document CN2711784Y discloses a timing device for speaking. The technical scheme of the utility model is that a switch, a current supply and a microphone on a timer are sequentially connected in series, and a switch, a current supply and an intimation light on the timer are sequentially connected in series. The utility model has the advantages of that the speaker can quantitatively control speaking time by the device, firstly the time is prefabricated, then the intimation light displays before the prefabricated time finishes, and at last the microphone is closed.

Foreign patent document CN203039847U discloses a timing control microphone having a time controller, a microphone, a buzzer and an indicator lamp, wherein the time controller is an electric timer, is respectively connected with the control microphone, the buzzer and the indicator lamp and can respectively control turn-on and turn-off of the microphone, the buzzer and the indicator lamp; the microphone is an amplifier voice microphone; the buzzer is an electric buzzer and the indicator lamp is a plurality of LED luminescent devices. The timing control microphone provided by the utility model has a time prompt function and is used for various conference amplification. By adopting sound and light signals to prompt, prolocutors' speech time can be effectively limited.

U.S. Pat. Pub. No. US20070030984A1 to Gotfried discloses a conference system. The system includes at least one control system, and a plurality of microphones configured to transmit an activation request to the control system. The control system generates an activation sequence for the microphones based on at least one activation request transmitted by a user for at least one of the microphones. The control system selectively activates each microphone for which an activation request has been transmitted. The selective activation occurs according to the generated activation sequence. One or more cameras may also be included for capturing video images of the users speaking into the microphones.

U.S. Pat. No. 4,090,032A to Schrader teaches a control system for an audio amplifying system having multiple microphones. Schrader's conference-type audio amplifier system has a plurality of voice-controlled microphones which produce individual output signals. Each microphone has an analog switch for turning the microphone on or off in response to its control signal relative to a reference threshold. Features of the system include: a number of microphones may be on simultaneously, and the remaining microphones (off) have their thresholds reduced by the on microphones; all the on microphones are kept on during speaker pause; simultaneous sound to multiple microphones (such as applause) causes no turn-on of any microphones and can reset the entire system, and one or more microphones switched to manual-control cause all the microphones switched to non-manual to be off.

Handheld two-way radio transceiver systems, i.e., walkie-talkies, use a single radio channel, and only one radio on the channel can transmit at a time, although any number can listen. The transceiver is normally in receive mode. When the user wants to talk they must press a "push-to-talk" (PTT) button that turns off the receiver and turns on the transmitter.

THE DELIBERATOR™ by DSan Corporation is an electronic meeting manager intended for city councils, community boards, planning commissions or corporate forums engaged in vigorous debate or public hearings. It allows members to self-regulate speaking order and control discussion times in an open and fair manner. It uses communications and display keypads that connect to a PC or laptop computer. It registers requests-to-speak, keeps time for every speaker and tallies keypad votes. Data is saved to files corresponding to discussion sessions that may be resumed precisely. It also allows voting, debate timings, speaker lists and announcements from THE DELIBERATOR™ to be displayed in real time on any computer running POWERPOINT™, including over a network.

While the foregoing body of art describes various means for disabling a speaker's microphone, it does not teach or suggest a microphone system enabled with a means for the speaker to simultaneously (or nearly simultaneously) disable his/her microphone and activate a subsequent microphone in series with his/her microphone. Such a system would provide the speaker adequate time for speaking, within pre-established time limits, while empowering the speaker to prevent unwanted interruption from other speakers.

SUMMARY OF THE INVENTION

The present system is an improved combination of a chess clock, i.e., timer, and a plurality of single-channel microphones, each having a STOP button. The system is designed for use in debates, for example, in Congress, Parliament, Presidential elections, online meetings, webinars, etc. to provide the speaker adequate time for speaking, within pre-established time limits, while empowering the speaker to prevent unwanted interruption from other speakers. The STOP button activates, or triggers activation of, the next speaker's microphone and timer while turning off the timer and microphone of the current speaker. The microphones do not include a means configured to activate themselves, e.g., a START button. In other words, a speaker cannot activate his/her own microphone using his/her microphone or a switch/button disposed thereon. Instead, the microphones are activated exclusively by the host (or other program/debate organizer) or the STOP button of another microphone. If the time limit is reached, STOP button-activated-control is relinquished to the next speaker and their timer and microphone is activated.

In an embodiment, the system includes displays for showing the amount of time remaining and/or elapsed for each speaker. Possible displays include lighted digital displays and/or a dial showing the remaining time of each speaker. The remaining/elapsed time of all the speakers may be displayed on computer screens of each participant. Additionally, or alternatively, the remaining/elapsed time of each speaker may be displayed on a television for the audience.

The amount of time for each timer is determined in advance of each speaker. Each timer may be configured to provide a standard time interval, e.g., 10 minutes, for each speaker. For example, the time limit for each speaker may be calculated by the system, based on a total time limit for the event divided by the sum of all the speakers. Alternatively, the timers may be configured to provide different amounts of time for various speakers, e.g., keynote speakers vs. other guest speakers. The time interval may be adjusted, e.g., increased or decreased, by the host of the program.

Following each speech, an optional commentary period may be permitted. The commentary period may include a predefined time limit for which a set group of individuals, e.g., moderators, questioners, and/or other speakers, have microphone control. The order of individuals having microphone control during the commentary period may be controlled by the host or other program organizer. Upon conclusion of the commentary period, microphone control is assigned to the next scheduled speaker and the predetermined order of speakers resumes. By following each speech with a commentary period, a speaking system akin to that seen in Congress, Parliament, Presidential elections or at a conference, for example, is created.

In an embodiment, when an individual is next in line to speak and is awaiting the conclusion of the current speaker, his/her timer displays the time remaining for the current speaker, e.g., in green, to indicate the remaining wait time before his/her time to speak. If the current speaker presses the STOP button before his/her time limit is reached, his/her remaining time is forfeited and the timer(s) is/are reset for the next speaker and the next speaker's microphone is activated.

In the case of an online meeting or webinar, speakers will utilize additional controls present on their microphone-enabled displays, e.g., a smartphone, a tablet, or a laptop computer. These additional controls may include a timer display and a STOP button for speakers and a queue of speakers for all participants. During the meeting, participants may be added to the queue of speakers. This can be done by the meeting host or on a first-come-first-served basis. The first speaker is given microphone control by the meeting host, at which point the speaker's timer starts. This timer will be displayed on-screen to the speaker, possibly with a red background to indicate that the speaker is active. Upon expiration of the speaker's timer or upon the speaker pressing his/her STOP button, whichever occurs first, the speaker relinquishes control of the microphone.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
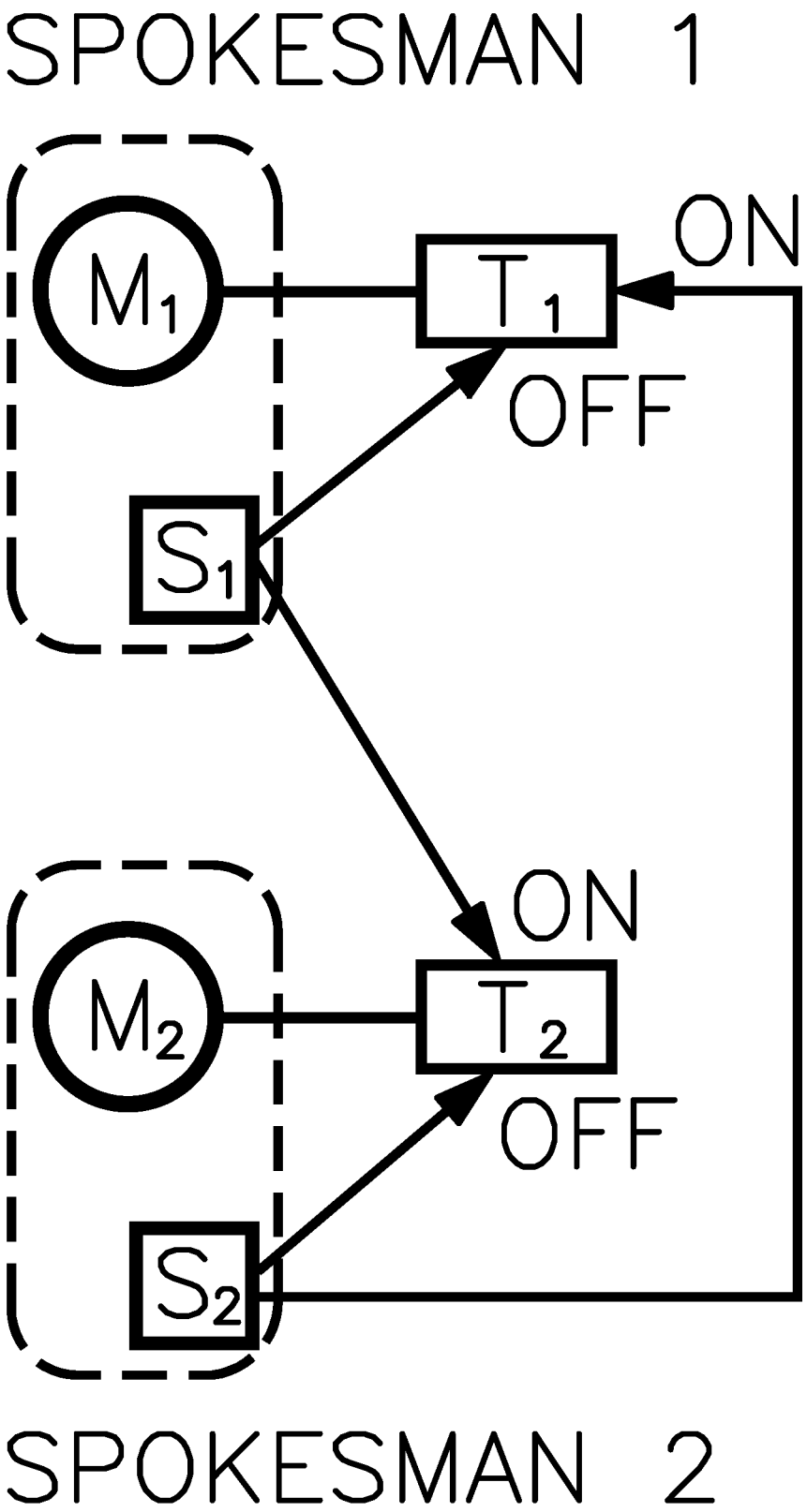
FIG. 1 shows a schematic diagram of the microphone system, according to an embodiment of the present invention.
Figure 2:
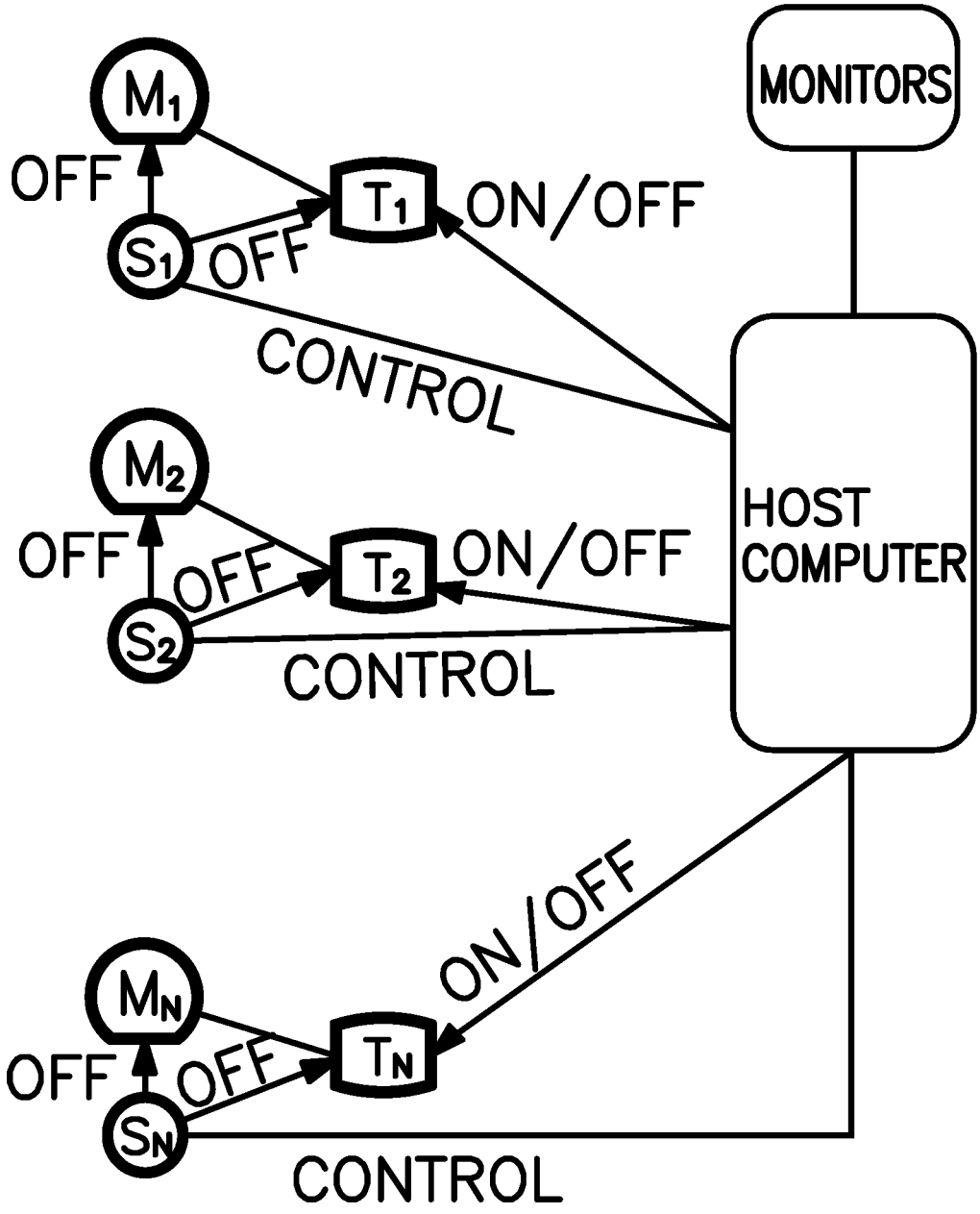
FIG. 2 shows a schematic diagram of the microphone system, according to an embodiment of the present invention.
Figure 3:
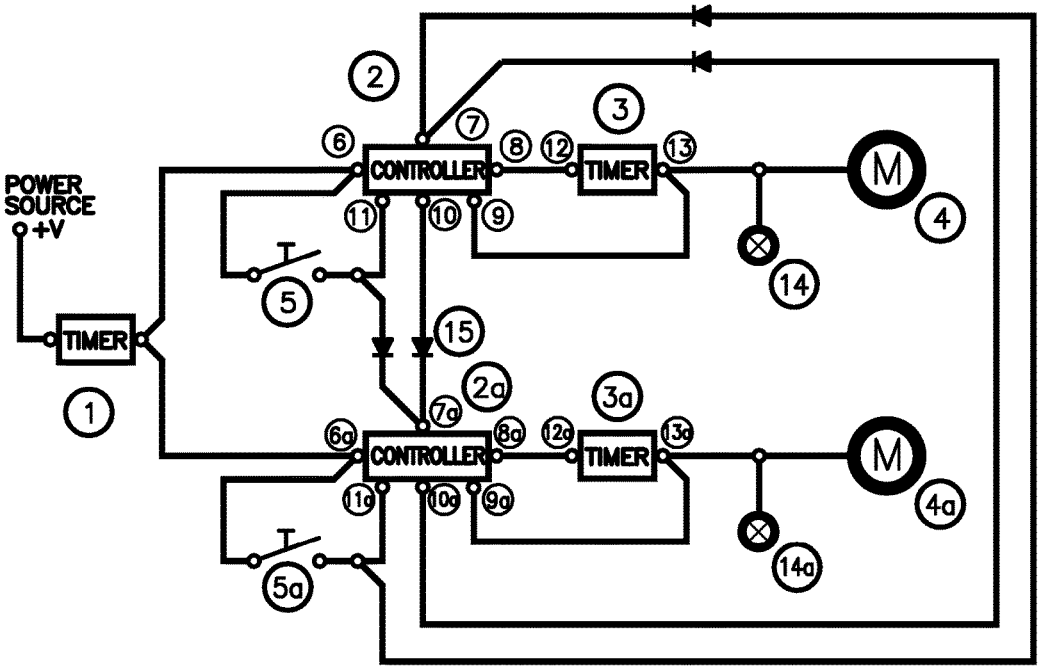
FIG. 3 shows a schematic diagram of the microphone system, according to an embodiment of the present invention.

Preferred embodiments of the present invention and their advantages may be understood by referring to FIGS. 1-3, wherein like reference numerals refer to like elements.

With reference to FIGS. 1-3, the present system includes at least one timer and a plurality of single-channel microphones, each having a STOP button. The STOP button of each microphone is disposed on, or in communication with, the respective microphone. The STOP button deactivates the timer and microphone of the current speaker and simultaneously (or nearly simultaneously) activates the next speaker's microphone and timer. The microphones do not include a START button. The microphone of the initial speaker is activated by the host (or other program/debate organizer) or the STOP button of another speaker. If the time limit is reached, STOP button-activated-control is relinquished to the next speaker, whereby the timer is reset and the next speaker's microphone is activated.

In an embodiment, the microphones are in communication with a central control unit. When the microphones are localized in a common location, communication between microphones and the central control unit may be accomplished either through microphone cables or via any known wireless communication technology, such as BLUETOOTH or WiFi. In a wireless embodiment, each microphone, or microphone-enabled device, the central control unit, and displays include wireless receivers and transmitters for transmitting and receiving wireless signals amongst the various system components. Alternatively, when the microphones are remotely located, communication between microphones and central control unit, e.g., a server, may be accomplished through the internet.

In an embodiment, each microphone includes a timer that is activated once the microphone is activated and, likewise, is deactivated once the microphone is deactivated. Additionally, or alternatively, the central control unit includes a central timer that tracks the overall debate time and, optionally, the time for each microphone. In an embodiment, whereby the central timer performs dual tracking, i.e., it tracks both the overall debate time and the time for the individual microphones, once a microphone is deactivated, a first timing mechanism of the central timer continues to count down the overall debate time and a second timing mechanism of the central timer resets for the next microphone. The first and second timing mechanisms can be any mechanism for tracking time, e.g., a clock or countdown timer.

The microphones are arranged in series, whereby the microphones are activated in a predefined order and only one microphone is operable at any given time. In an embodiment, the microphones are organized in a circuit or loop, such that once all speakers have spoken, the original order of speakers may repeat. In other words, once the final speaker's timer lapses or he/she presses his/her STOP button, his/her microphone is deactivated, and the first speaker's timer is reset and his/her microphone is reactivated. All microphones are inoperable unless and until they are activated. As such, engagement, e.g., depression, of the STOP button on an inoperable microphone has no active, i.e., interruptive, effect on the system. Any number of microphones may be added or subtracted from the system, depending on the number of speakers.

In an embodiment, the system includes displays for showing the amount of time remaining and/or elapsed for each speaker. Possible displays include lighted digital displays and/or a dial showing the remaining/elapsed time of each speaker. The displays are in communication, wired or wireless, with the central control unit, allowing for the remaining/elapsed time of all the speakers to be transmitted from the central control unit to each participant's display. Additionally, or alternatively, one or more displays for the audience may be in communication with the central control unit, allowing the remaining/elapsed time of each speaker to be on display for the audience.

The amount of time for each timer is determined in advance for each speaker. Each timer may be configured to provide a standard time interval, e.g., 10 minutes, for each speaker. For example, the time limit for each speaker may be calculated by the system, based on a total time limit for the event divided by the sum of all the speakers. Alternatively, the timers may be configured to provide different amounts of time for various speakers, e.g., keynote speakers vs. other guest speakers. The time interval may be adjusted, e.g., increased, by the host of the program.

Following each speech, an optional commentary period may be permitted. In an embodiment, if a speaker presses his/her STOP button during another speaker's speech, a signal is transmitted to the host, informing him/her that someone wants to provide a comment. This allows the debate participants' desire to speak out of order to be acknowledged without interrupting the present speaker's speech. In response to the signal(s), the host, at his/her discretion, may provide an opportunity for the other speaker(s) to provide comment. The commentary period may include a predefined time limit for which a defined group of individuals, e.g., moderators, questioners, and/or other speakers, have microphone control. The order of individuals having microphone control during the commentary period may be controlled by the host or other program organizer. This may be executed using the central control unit or any other electronic control device in communication with the central control unit, e.g., a laptop, smartphone, or tablet. Upon conclusion of the commentary period, microphone control is assigned to the next scheduled speaker and the predetermined order of speakers resumes. By following each speech with a commentary period, an interactive debate system akin to that seen in Congress, Parliament, Presidential elections or at a conference, for example, is created.

If necessary, e.g., for questioning, etc., the host may interrupt a speaker using the central control unit or any other electronic control device in communication with the central control unit. If a speaker is interrupted, the speaker's timer stops. During this time of interruption, the host may activate microphones out of order and designate time limits for the activated microphones. Once the last speaker is done speaking, either due to exhaustion of the allotted time or engagement, e.g., depression, of the speaker's STOP button, the interrupted speaker's microphone and timer is reactivated, whereby the timer resumes at the point at which it was stopped, and the pre-determined order resumes.

When a user is next to speak, but is still waiting for the conclusion of the previous speaker, his/her timer will show the time remaining of the active speaker, possibly in green to indicate the remaining wait time. If the active speaker presses the STOP button before his/her time limit has been reached, his/her remaining time will be forfeited and the timer will be reset for the next speaker and the next speaker's microphone will be activated.

In the case of an online meeting or webinar, speakers may utilize additional controls present on their microphone-enabled displays, e.g., a smartphone, a tablet, or a laptop computer. These additional controls may include a timer display and a STOP button for speakers and a queue of speakers for all participants. During the fleeting, participants may be added to the queue of speakers. This can be done by the meeting host or on a first-come-first-served basis. The first speaker is given microphone control by the meeting host, at which point the speaker's timer starts. This timer will be displayed on-screen to the speaker, possibly with a red background to indicate that the speaker is active. Upon the conclusion of the speaker's timer or upon the speaker pressing his/her STOP button, whichever occurs first, the speaker relinquishes control of the microphone.

Methods of Use

In an embodiment, a method of using the present system begins with assigning a speaking order and time limit to the speakers. The order of speaking and time limits for each speaker are then input into the central control unit, and each speaker is assigned a microphone that corresponds to his/her assigned order. Once the first speaker is ready to begin, the host instructs the central control unit to activate the speaker's microphone and timer. The central control unit then transmits a signal that activates, i.e., opens, the first speaker's microphone and starts his/her timer. Additionally, or alternatively, the system may be configured such that the STOP button of a pre-assigned speaker's microphone is configured to activate the first speaker's microphone.

Once the first speaker is done speaking and presses his/her STOP button or his/her time runs out, whichever occurs first, his/her microphone is deactivated, i.e., closed, whereby the microphone transmits a signal to the central control unit to activate the next speaker's microphone and timer. Just as with the first speaker, once the subsequent speaker presses his/her STOP button or his/her time runs out, whichever occurs first, his/her microphone is deactivated, i.e., closed, whereby the microphone transmits a signal to the central control unit to activate the next speaker's microphone and timer. This process continues until all speakers have spoken at least once.

In an embodiment that permits the speakers to speak multiple times, once the final speaker presses his/her STOP button or his/her time runs out, whichever occurs first, his/her microphone is deactivated, i.e., closed, whereby the microphone transmits a signal to the central control unit to transmit a signal to reactivate the next, i.e., the first, speaker's microphone and timer, such that the original order of speaking would be repeated.

In an example, as illustrated in FIG. 1, when the speakers come up and take their microphones $M_1$, $M_2$, the microphones $M_1$, $M_2$ and respective timers $T_1$, $T_2$ are in a deactivated state. Then, by lot or by prior arrangement the second speaker engages his/her smart switch $S_2$, i.e., the STOP button, to start, i.e., activate, the microphone $M_1$ and timer $T_1$ of the first speaker.

Upon activation, the timer $T_1$ summarizes, e.g., counts down, the time of speech of the first speaker and deactivates his/her microphone when the pre-determined time limit is reached. If the first speaker finishes speaking before his/her timer $T_1$ lapses, he/she may engage his/her smart switch $S_1$. Once engaged, the smart switch $S_1$ deactivates the first speaker's microphone $M_1$ and timer $T_1$ and simultaneously (or nearly simultaneously) activates the second speaker's microphone $M_2$ and timer $T_2$.

In another example, as illustrated in FIG. 2, the microphones $M_1$, $M_2$, $M_N$ are in communication with a central control unit, e.g., a host computer or other electronic processing and control unit. The central control unit is controlled by the host or other event organizer, e.g., an individual in Parliament, a television show host or moderator, etc. One or more monitors, e.g., debate participants' computers, televisions, etc. are also in communication with the central control unit.

When the speakers come up and take their microphones $M_1$, $M_2$, $M_N$, the microphones $M_1$, $M_2$, $M_N$ and respective timers $T_1$, $T_2$, $T_N$ are in a deactivated state. Then, by lot or by prior arrangement, one of the speakers, other than the first speaker, engages his/her smart switch $S_2$, $S_N$ to activate the microphone $M_1$ and timer $T_1$ of the first speaker. Alternatively, the host or other program organizer may activate the first speaker's microphone $M_1$ and timer $T_1$ using the central control unit.

Upon activation, the timer $T_1$ summarizes, e.g., counts down, the time of speech of the first speaker and deactivates his/her microphone when the pre-determined time limit is reached. If the first speaker finishes speaking before his/her timer $T_1$ lapses, he/she may engage his/her smart switch $S_1$. Once engaged, the smart switch $S_1$ deactivates the first speaker's microphone $M_1$ and timer $T_1$ and simultaneously (or nearly simultaneously) activates the next speaker's microphone $M_2$ and timer $T_2$. This process continues until all speakers have spoken at least once.

As a further example, FIG. 3 illustrates a method of using a two-line communication system, according to an embodiment of the present invention. Following is a list of system components and related I/O connections illustrated in FIG. 3.

Components:

1—Timer, overall debate time count;
2, 2*a*—Controllers;
3, 3*a*—Timers, single speech duration;
4, 4*a*—Microphones;
5, 5*a*—Switches;
14, 14*a* (optional)—indicators, microphone ON;
Controller (Items 2, 2*a*) Input/Output Connections:
6, 6*a*—Inputs, power;
7, 7*a*—Inputs, Timer activation;
8, 8*a*—Outputs, power to timer;
9, 9*a*—Inputs, feedback from timer;
10, 10*a*—Outputs, next line timer activation;
11, 11*a*—Inputs, timer stop and reset;
Timer (items 3, 3*a*) input/output connections:
12, 12*a*—Inputs, power;
13, 13*a*—Outputs, power to microphone;
Auxiliary:
14, 14*a*—indicators, timer ON; and
15 (4 pieces) diode.

A debate (or other speaking event) starts by activating timer 1 and a speaker pressing his/her switch 5, 5*a*, i.e., STOP button, depending on which speaker is designated to open the debate. For example, if switch 5 is pressed first, input 11 is activated and controller 2 blocks timer 3 (no power on output 8). At the same time, the signal from switch 5 is sent to input 7*a*, therefore controller 2*a*, via output 8*a*, powers timer 3*a* which, in turn, via output 13*a*, powers microphone 4*a*.

If the first speaker uses all of his/her designated/allotted time, e.g., 5 min, then, upon expiration of his/her allotted time, timer 3*a* stops and its output 13*a* voltage turns to zero disabling microphone 4*a*. Controller 2*a* monitors the voltage level of timer 3*a* output via input 9*a*. When the voltage level of timer 3*a* output reaches zero it sends a signal via output 10*a* to controller 2 input 7 activating timer 3 and microphone 4.

If the first speaker does not use all of his/her designated time and decides, instead, to give speaking authority to the second speaker before his/her time expires, the first speaker presses switch 5*a*. Pressing switch 5*a* sends a signal to input 11*a* and controller 2*a* blocks timer 3*a*, which automatically resets itself to zero. Simultaneously (or nearly simultaneously), a signal is sent to input 7, activating timer 3 and microphone 4.

The cycle repeats itself symmetrically when the second speaker finishes his/her speech. One skilled in the art would understand and appreciate that the system is scalable to as many speakers as needed by adding additional components, i.e., controllers, timers and microphones for the additional speakers.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. A communication system comprising:

two or more microphones, each microphone comprising a stop button; and a central control unit in communication with the microphones, wherein the central control unit comprises a timer comprising:

a first timing mechanism configured to track an overall time for the two or more microphones; and a second timing mechanism configured to track a time for each microphone while in an active state, wherein a pre-determined order of activation is assigned to the two or more microphones, and wherein a time limit is assigned to each microphone, wherein the order of activation and assigned time limits are inputted into the central control unit, wherein only one microphone is active at any given time, wherein the first timing mechanism, the second timing mechanism and a first microphone are activated by the central control unit, wherein triggering of the stop button of an active microphone or expiration of the time limit assigned to the active microphone, whichever occurs first, is configured to deactivate the active microphone, reset and reactivate the second timing mechanism and activate a subsequent microphone according to the assigned time limits and pre-determined order of activation, wherein each microphone is activated at least once.

2. The communication system of claim 1, wherein an inactive microphone does not include a means configured to activate the inactive microphone.

3. The communication system of claim 1, wherein the time limit is the same for all microphones.

4. The communication system of claim 1, wherein the time limit is different for at least one of the microphones.

5. The communication system of claim 1, further comprising a plurality of displays in communication with the central control unit.

* * * * *